US008256755B2

(12) United States Patent
Hiromatsu

(10) Patent No.: US 8,256,755 B2
(45) Date of Patent: Sep. 4, 2012

(54) CLAMP APPARATUS

(75) Inventor: Yoshinori Hiromatsu, Toride (JP)

(73) Assignee: SMC Kabushiki Kaisha, Tokyo (JP)

( * ) Notice: Subject to any disclaimer, the term of this patent is extended or adjusted under 35 U.S.C. 154(b) by 859 days.

(21) Appl. No.: 12/336,047

(22) Filed: Dec. 16, 2008

(65) Prior Publication Data

US 2009/0184451 A1 Jul. 23, 2009

(30) Foreign Application Priority Data

Jan. 22, 2008 (JP) ..... 2008-011134

(51) Int. Cl.
*B25B 5/06* (2006.01)
*B25B 5/04* (2006.01)

(52) U.S. Cl. ..... 269/238; 269/228; 269/32; 269/24

(58) Field of Classification Search ..... 269/24–27, 269/32, 201, 228, 238
See application file for complete search history.

(56) References Cited

U.S. PATENT DOCUMENTS

| | | | | |
|---|---|---|---|---|
| 5,829,112 | A * | 11/1998 | Blatt | 29/416 |
| 6,364,300 | B1 * | 4/2002 | Kita | 269/32 |
| 6,378,855 | B1 * | 4/2002 | Sawdon et al. | 269/32 |
| 6,439,560 | B2 * | 8/2002 | Sawada et al. | 269/32 |
| 6,931,980 | B1 * | 8/2005 | Zajac, Jr. et al. | 91/396 |
| 7,108,255 | B2 * | 9/2006 | Zajac et al. | 269/32 |
| 7,144,002 | B2 * | 12/2006 | Zhao et al. | 269/32 |
| 7,370,856 | B2 * | 5/2008 | Sawdon et al. | 269/49 |
| 7,584,946 | B2 * | 9/2009 | Doi | 269/32 |
| 8,132,801 | B2 * | 3/2012 | Miyashita et al. | 269/49 |
| 8,146,900 | B2 * | 4/2012 | Miyashita et al. | 269/32 |
| 2005/0230893 | A1 * | 10/2005 | Zajac et al. | 269/32 |
| 2005/0269755 | A1 * | 12/2005 | Zhao et al. | 269/32 |
| 2006/0049565 | A1 * | 3/2006 | Petit et al. | 269/32 |
| 2009/0184451 | A1 * | 7/2009 | Hiromatsu | 269/238 |

FOREIGN PATENT DOCUMENTS

| | | | |
|---|---|---|---|
| DE | 297 13 607 | U1 | 9/1997 |
| DE | 10 2004 007 346 | B3 | 4/2005 |
| EP | 0 615 817 | A1 | 9/1994 |
| EP | 1 524 080 | A1 | 4/2005 |
| JP | 2005-61526 | | 3/2005 |
| WO | WO 2005/044517 | A3 | 5/2005 |

* cited by examiner

*Primary Examiner* — Lee D Wilson
(74) *Attorney, Agent, or Firm* — Oblon, Spivak, McClelland, Maier & Neustadt, L.L.P.

(57) ABSTRACT

A clamp apparatus includes a clamp unit capable of retaining a workpiece, a cylinder driven under the supply of a pressure fluid, and a drive force transmission mechanism, which is capable of transmitting a drive force from the cylinder to the clamp unit. The drive force transmission mechanism includes a guide body disposed displaceably inside of a body, two pairs of rollers retained rotatably on both side surfaces of the guide body, and a spindle inserted through a second link groove of the guide body that rotatably supports a clamp arm. The clamp arm is rotatably operated and is capable of clamping the workpiece under a displacement action of the guide body.

9 Claims, 12 Drawing Sheets

CLAMP APPARATUS

BACKGROUND OF THE INVENTION

1. Field of the Invention

The present invention relates to a clamp apparatus, which is capable of retaining a workpiece by a clamp arm through a drive force of a driving section.

2. Description of the Related Art

Heretofore, for example, when structural components of an automobile or the like are welded, a clamp apparatus is used for clamping the structural components.

In this type of clamp apparatus, for example, a piston is displaced under the supply of air, thereby causing rotary movement of a clamp arm through the piston for clamping the workpiece. However, in a state in which the workpiece is clamped, in the event that the supply of air is halted for some reason, the clamped state of the clamp arm with respect to the workpiece becomes released and the held state of the workpiece cannot be maintained, thus resulting in the workpiece being dropped from the clamp apparatus or the like.

In response to the aforementioned problems, for example, a clamp apparatus is known, which is equipped with a locking mechanism capable of regulating the rotary movement of a clamp arm. As disclosed in Japanese Laid-Open Patent Publication No. 2005-061526, in such a clamp apparatus, a lock rod is connected to a piston that slides in a cylinder body and is displaced integrally with the piston, while in addition, the clamp arm is disposed rotatably through a toggle mechanism on a piston rod connected to the piston, whereby the clamp arm is operated to open and close by displacement of the piston.

Further, a locking cylinder is disposed displaceably in a head cover of the cylinder body, the locking cylinder being disposed perpendicular to the axis of the cylinder body, with a locking piston disposed for displacement in the interior thereof. In addition, the locking piston is urged toward the side of a lock rod by a locking spring, such that by insertion of the locking piston into a recess of the lock rod, displacement of the lock rod is regulated along with regulating the rotary movement of the clamp arm.

However, in the aforementioned conventional technique, the clamp arm is stopped by insertion of the locking piston into the recess of the lock rod, which is urged by means of the locking spring. As a result, the clamping force applied to the workpiece tends to be small. In addition, in the case that a variance occurs in the thickness of the workpiece, the clamped state becomes unstable, and there is a fear that the workpiece may be subjected to shifting and cannot be positioned at a desired position.

Further, because the locking cylinder, including the locking spring and the locking piston, must be assembled in the clamp apparatus, the structure of the clamp apparatus is complicated and made larger in scale.

SUMMARY OF THE INVENTION

A general object of the present invention is to provide a clamp apparatus, which can reliably retain workpieces by means of a simple structure, and further in which the retaining force thereof can suitably be maintained.

In order to achieve the above object, the present invention is characterized by a clamp apparatus for converting linear motion output from a driving section into rotary motion and clamping a workpiece through a clamp arm, the clamp apparatus including:

a body;

a driving section connected to the body and having a displacement rod that is displaceable along an axial direction of the body;

a clamp arm supported rotatably with respect to the body;

a drive force transmission mechanism including a displacement body connected to the displacement rod for displacement along the body, and a link groove extending in an axial direction of the displacement body and through which a spindle that supports an end of the clamp arm is inserted, the drive force transmission mechanism transmitting a drive force from the driving section to the clamp arm, wherein the clamp arm is rotatably displaced by causing displacement of the spindle along the link groove; and a thrust increasing mechanism disposed in the drive force transmission mechanism for increasing a clamping force when the workpiece is retained by the clamp arm, wherein the thrust increasing mechanism is made up from an inclined portion, which is formed in the link groove and extends while being inclined at a predetermined angle with respect to an axis of the displacement body, and further, wherein the spindle engages with the inclined portion at a time of clamping when the workpiece is supported by the clamp arm, and wherein the inclined portion causes gradual rotation of the clamp arm via the spindle in a direction for clamping the workpiece.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIGS. 10A and 10B depict a modified example, in which a second groove portion of a second link groove is further extended beyond that of the clamp apparatus shown in FIGS. 9A and 9B, wherein FIG. 10A is an operational explanatory diagram showing an initial state of clamping by the clamp arm, and FIG. 10B is an operational explanatory diagram showing a condition in which the clamp arm is further rotated due to further displacement of a guide member;

DESCRIPTION OF THE PREFERRED EMBODIMENTS

Figure 1:
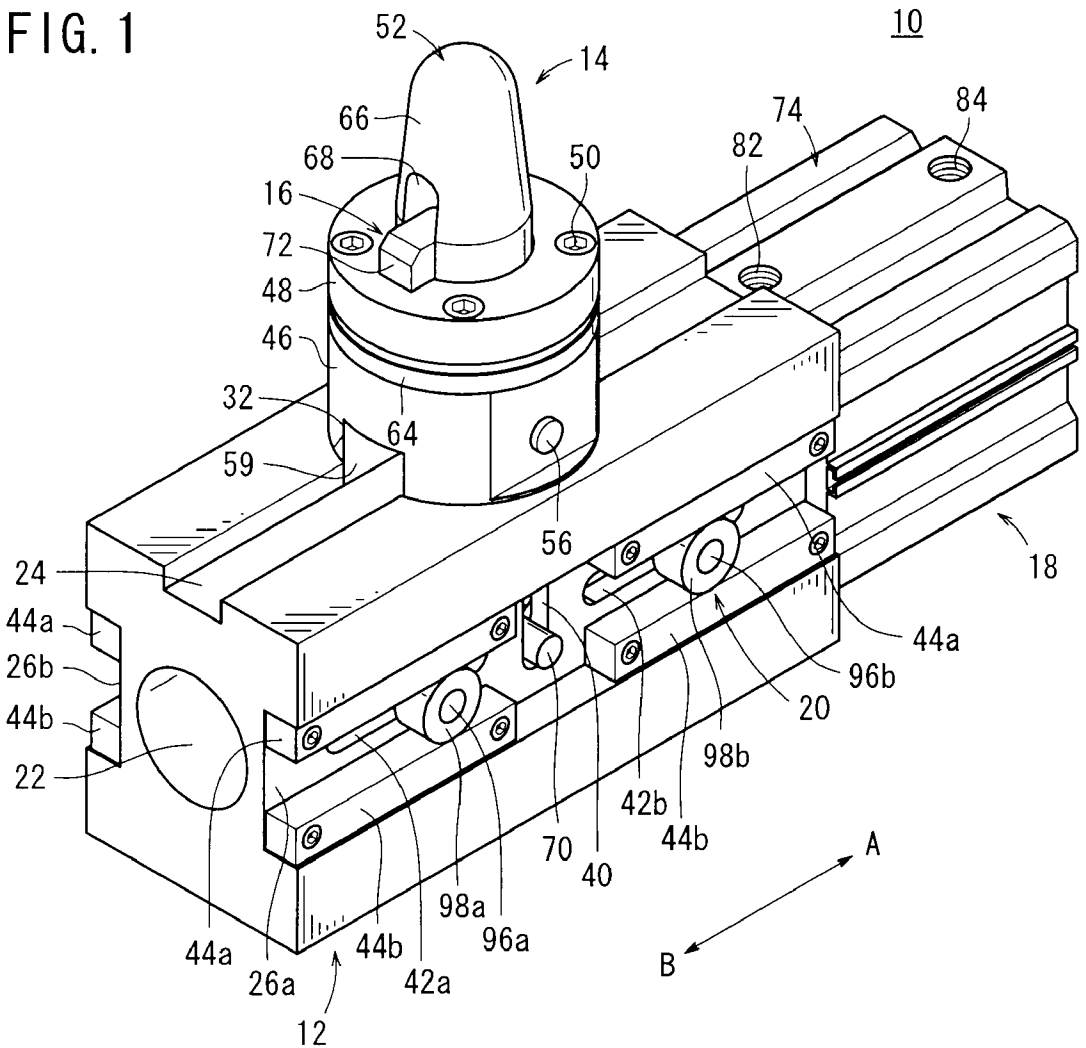
FIG. 1 is an exterior perspective view of a clamp apparatus according to a first embodiment of the present invention.

In FIG. 1, reference numeral 10 indicates a clamp apparatus according to a first embodiment of the present invention.

The clamp apparatus 10, as shown in FIGS. 1 to 7, includes a hollow body 12, a clamp unit 14 disposed on an upper portion of the body 12, which is capable of retaining a workpiece W (see FIG. 4), a cylinder (driving section) 18 connected to an end of the body 12, which is capable of rotating a clamp arm 16 of the clamp unit 14 under the supply of a pressure fluid, and a drive force transmission mechanism 20 disposed in the interior of the body 12, which is capable of transmitting a drive force from the cylinder 18 to the clamp unit 14. The workpiece W retained by the clamp apparatus 10, for example, comprises a panel formed from a plate-like material, which is used in an automobile. The clamp apparatus 10 is used in a production line in which such an automotive panel is retained and is welded.

The body 12 is formed with a substantially rectangular shape in cross section, and includes a through hole 22 formed along an axial direction (the direction of the arrows A and B) in a center portion of the body 12, a first recess 24 that extends along the axial direction and is formed in the center of an upper surface thereof, and a pair of second recesses 26*a*, 26*b* formed on both side surfaces perpendicular to the upper surface, and which extend in the axial direction. The first and second recesses 24, 26*a*, 26*b* are formed by recessing the side surfaces of the body 12 at a predetermined depth with a U-shape in cross section, the recesses 24, 26*a*, 26*b* being formed substantially in parallel with each other.

A guide body (displacement body) 28 constituting the drive force transmission mechanism 20 is disposed displaceably inside of the through hole 22, and a portion of a piston rod (displacement rod) 30 that makes up the cylinder 18 also is inserted through the through hole 22.

Figure 2:
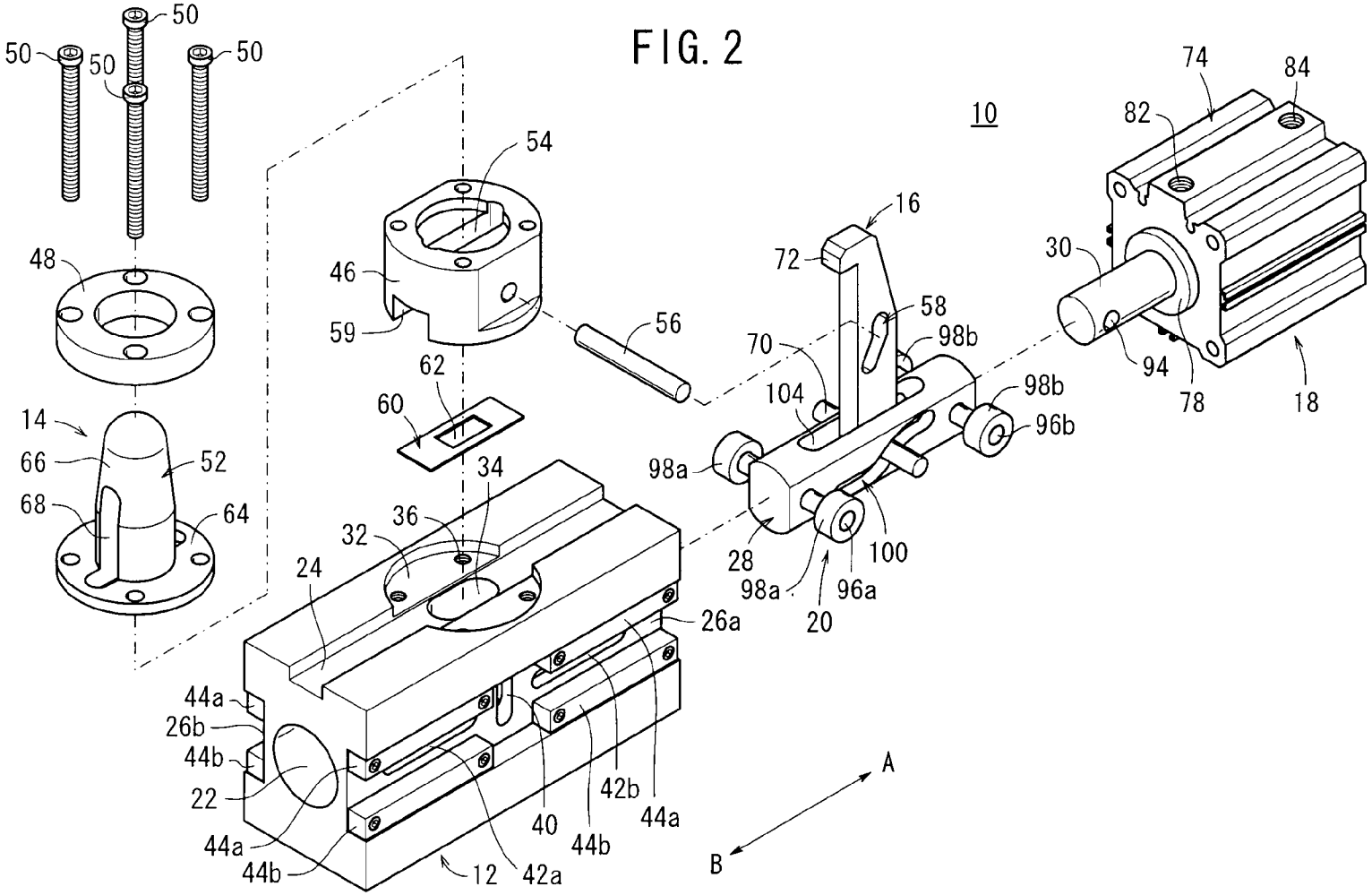
FIG. 2 is an exploded perspective view of the clamp apparatus shown in FIG. 1.
Figure 3:
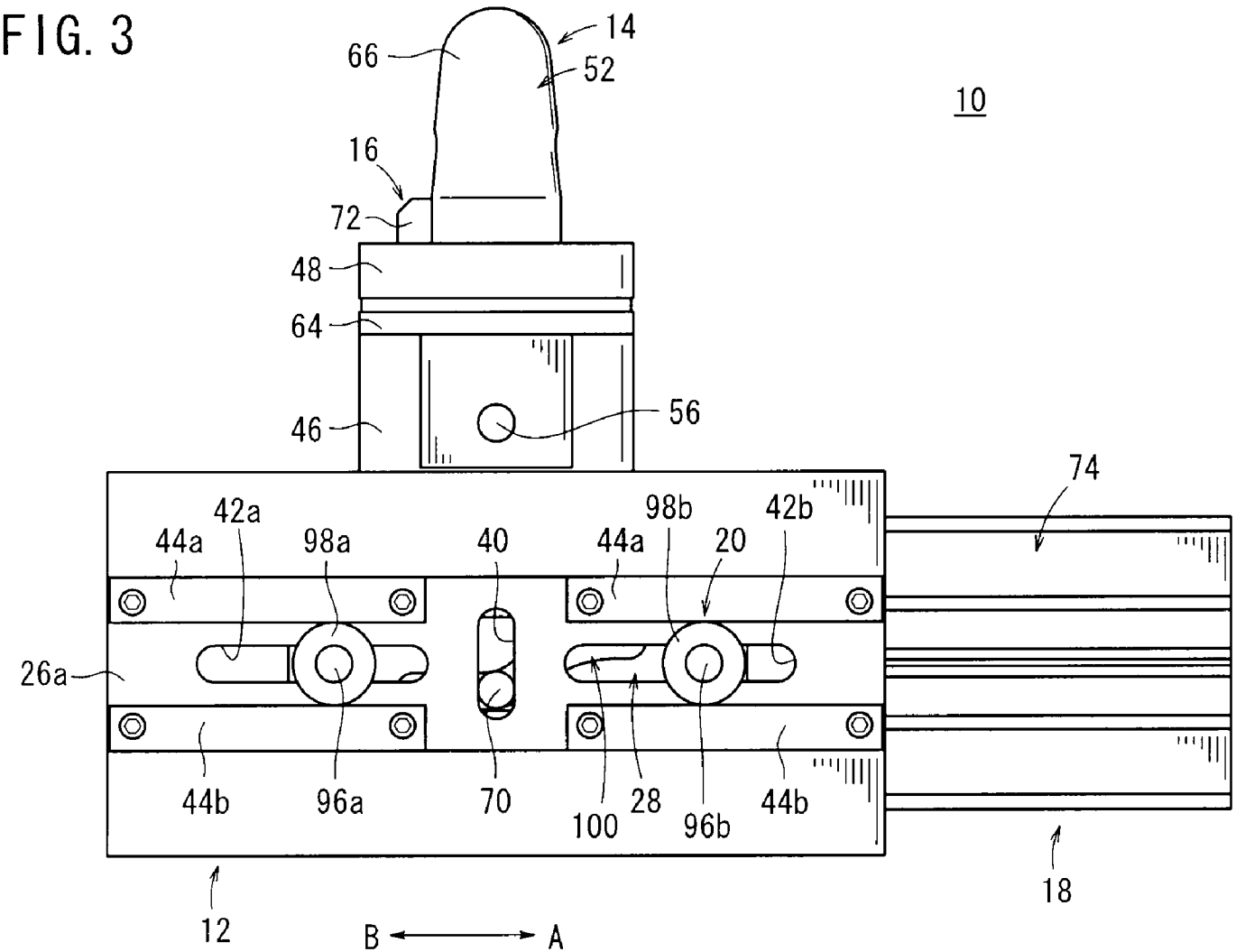
FIG. 3 is a side plan view of the clamp apparatus of FIG. 1.

As shown in FIG. 2, a mounting hole 32, which is formed in a cross sectional circular shape and in which the clamp unit 14 is installed, is formed in a central portion of the first recess 24, and an elliptical shaped opening 34 is provided in the center of the mounting hole 32. The opening 34 is formed so as to have an elongate axis extending in the lengthwise direction of the first recess 24, and communicates with the through hole 22. The clamp arm 16 that makes up the clamp unit 14 is inserted through the opening 34.

Further, plural bolt holes 36 are disposed in the mounting hole 32, while being mutually separated by equal distances surrounding the center of the opening 34.

On the other hand, a discharge hole (hole) 38 is formed at a position facing the opening 34, while sandwiching the through hole 22 on a lower portion of the body 12. The through hole 22 and the exterior of the apparatus 10 communicate through the discharge hole 38. The discharge hole 38 is provided in order to discharge foreign matter, which has invaded inside of the body 12, to the outside.

Link holes 40 formed substantially centrally in the axial direction, together with pairs of guide holes 42*a*, 42*b*, which are provided respectively on one end side and the other end side of the body 12 centrally about the link holes 40, are formed on the second recesses 26*a*, 26*b*.

The link holes 40 extend in a perpendicular direction (the direction of arrows C and D in FIG. 4) to the direction (the direction of arrows A and B) in which the second recesses 26*a*, 26*b* extend, whereas the guide holes 42*a*, 42*b* are formed with predetermined lengths along the extending direction of the second recesses 26*a*, 26*b*. Specifically, the link holes 40 and the guide holes 42*a*, 42*b* are formed so as to be mutually perpendicular with respect to each other.

Further, pairs of guide rails 44*a*, 44*b* are installed respectively on both sides about the guide holes 42*a*, 42*b* in the second recesses 26*a*, 26*b*, such that the guide rails 44*a*, 44*b* are disposed and separated mutually from each other by a predetermined distance. The guide rails 44*a*, 44*b* are formed in straight linear shapes having predetermined lengths, and are affixed along respective inner wall surfaces of the second recesses 26*a*, 26*b*.

The clamp unit 14 includes a cylindrical main body portion 46 installed in the mounting hole 32 of the body 12, a cap 52 affixed to an upper part of the main body portion 46 through a plate 48 and bolts 50, and the clamp arm 16, which is inserted through the interior of the main body portion 46 and the cap 52, and is rotatable by a drive force from the drive force transmission mechanism 20.

Additionally, by insertion of the plural bolts 50 through holes of the plate 48, the cap 52, and the main body portion 46 and screw-engagement of the bolts 50 into the bolt holes 36 of the body 12, the clamp unit 14 including the plate 48, the cap 52 and the main body portion 46 is affixed to an upper portion of the body 12.

A first arm hole 54, through which the clamp arm 16 is inserted, is formed in the axial direction in the main body portion 46, and a link shaft 56 is provided perpendicularly to the first arm hole 54. The link shaft 56 is inserted through a first link groove 58 of the clamp arm 16 in the interior of the first arm hole 54.

Further, cutouts (discharge openings) 59 facing the first recess 24 are disposed on a lower portion of the main body portion 46, the first arm hole 54 communicating with the exterior through the cutouts 59, which are substantially rectangular in cross section. The cutouts 59 are provided in a pair, and are positioned along a straight line located centrally about the first arm hole 54. Stated otherwise, the cutouts 59 are disposed respectively upwardly of the first recess 24 (see FIG. 4).

Furthermore, a rectangular cover 60 is disposed on the lower part of the main body portion 46 between the opening 34 of the body 12 and the main body portion 46. The cover 60 is formed by a thin plate and is disposed in a position facing the opening 34 of the body 12. In addition, the width dimension of the cover 60 is set substantially the same as the width dimension of the first recess 24, so that the cover 60 is disposed for displacement along the first recess. A rectangular insertion hole 62 is formed in the center of the cover 60, through which the clamp arm 16 is inserted, while also being inserted through the opening 34 of the body 12.

More specifically, the clamp arm 16 is inserted through the interior of the body 12 and the clamp unit 14 while passing through the insertion hole 62 of the cover 60. The opening area of the insertion hole 62 is set to be smaller than the opening area of the opening 34.

The cap 52 is made up of a disk shaped base portion 64 affixed to the main body portion 46, and a cylindrical portion 66 that projects at a predetermined height with respect to the base portion 64. A slit hole 68, through which a portion of the clamp arm 16 can be exposed to the exterior, is provided on a side surface of the cylindrical portion 66. The slit hole 68 is formed at a predetermined height from the base portion 64 along the axial direction of the cap 52.

Further, the cylindrical portion 66 is formed so as to gradually be reduced in diameter in a direction (the direction of the arrow D) separating away from the base portion 64, the end thereof being formed in a spherical shape. With the cylindrical portion 66, for example, when an automotive panel or the like is retained, positioning thereof is carried out by insertion of the cylindrical portion 66 through a hole or opening provided in the automotive panel. More specifically, the cylindrical portion 66 constituting the clamp unit 14 includes a positioning function, for carrying out positioning of the workpiece W with respect to the clamp apparatus 10.

The clamp arm 16 is formed from a block body having a fixed thickness, and includes a predetermined length in the longitudinal direction. A spindle 70 of the drive force transmission mechanism 20 is inserted through one end of the clamp arm 16, in addition to being inserted into the guide body 28 of the drive force transmission mechanism 20. Additionally, by insertion of the spindle 70, which is perpendicular to the longitudinal direction of the clamp arm 16, through the clamp arm 16 and the guide body 28, the clamp arm 16 is latched (fixedly engaged) with respect to the guide body 28.

On the other hand, a claw 72, which is bent at a right angle with respect to the longitudinal direction of the clamp arm 16, is disposed on the other end of the clamp arm 16. The claw 72 is capable of retaining the workpiece W by rotation of the clamp arm 16.

Further, the first link groove 58 is formed in the center of the clamp arm 16, such that the link shaft 56 is inserted through the first link groove 58 when the clamp arm 16 is inserted through the interior of the main body portion 46. The first link groove 58 is constituted of a first groove portion 58*a* formed on the other end side of the clamp arm 16 having the claw 72, and a second groove portion 58*b* formed on the one end side of the clamp arm 16. The first groove portion 58*a* extends for a predetermined length parallel to the longitudinal direction of the clamp arm 16, whereas the second groove portion 58*b* is inclined at a predetermined angle from the joint with the first groove portion 58*a* toward one side surface of the clamp arm 16 that includes the claw 72. In other words, the second groove portion 58*b* is inclined at a predetermined angle with respect to the direction of extension of the first groove portion 58*a*, and extends toward the one end side of the clamp arm 16.

The cylinder 18 includes a cylinder tube 74 with a bottomed tubular shape, a piston 76 disposed displaceably inside of the cylinder tube 74, a piston rod 30 connected to an end of the piston 76, and a rod cover 78 that closes an end of the cylinder tube 74 and supports the piston rod 30 therein.

The open end of the cylinder tube 74 is connected to the end of the body 12, with a cylinder cavity 80 being formed in the interior thereof. Further, first and second ports 82, 84 through which a pressure fluid is supplied and discharged, are formed in a side surface of the cylinder tube 74, which are disposed and separated from each other by a predetermined distance along the axial direction (the direction of arrows A and B) of the cylinder tube 74. The first and second ports 82, 84 communicate respectively through communication passages with the cylinder cavity 80. That is, the pressure fluid supplied to the first and second ports 82, 84 is introduced through the communication passages to the interior of the cylinder cavity 80.

The piston 76 is disposed for displacement along the cylinder cavity 80, with a piston packing 86 and a magnet 88 being mounted through annular grooves on the outer circumferential surface of the piston 76. Further, a hole penetrates through the center of the piston 76, with one end of the elongate piston rod 30 being inserted through and connected to the piston 76.

The piston rod 30 extends over a predetermined length toward the open end side of the cylinder tube 74, and is inserted through and supported by the rod hole 90 of the rod cover 78, while the other end of the piston rod 30 serving as a tip end thereof is inserted into the through hole 22 of the body 12. An annular rod packing 92 is mounted in the rod hole 90, so that airtightness of the cylinder cavity 80 is preserved, by the rod packing 92 making sliding contact with the outer circumferential surface of the piston rod 30.

Further, a connecting hole 94 that penetrates in a direction perpendicular to the axis of the piston rod 30 is formed in the other end of the piston rod 30, through which a roller axis 96*b* that makes up part of the drive force transmission mechanism 20 is inserted. As a result, the guide body 28 of the drive force transmission mechanism 20 and the piston rod 30 are interconnected, and the guide body 28 is displaced integrally with the piston rod 30 upon displacement of the piston rod 30.

The drive force transmission mechanism 20 includes the guide body 28, which is arranged in the through hole 22 of the body 12 and is formed in a block-like shape, two pairs of rotating rollers 98*a*, 98*b* that are retained rotatably on both side surfaces of the guide body 28, a spindle 70 that is inserted through second link grooves 100 of the guide body 28 and which rotatably supports the clamp arm 16, and four pairs of guide rails 44*a*, 44*b* disposed on both side surfaces of the body 12 for guiding the rollers 98*a*, 98*b* along the axial directions (the directions of arrows A and B) of the body 12.

The guide body 28 is formed with a substantially rectangular shape in cross section having a pair of arcuate surfaces, and further is formed with a connecting hole 102 on an end thereof facing the cylinder 18. The piston rod 30 of the cylinder 18 is inserted into the interior of the connecting hole 102. Moreover, when the guide body 28 is inserted into the through hole 22 of the body 12, the pair of arcuate surfaces are arranged in sliding contact respectively with inner wall surfaces of the through hole 22 and are guided along the axial direction of the body 12, while the arcuate surfaces are disposed respectively on upper and lower sides of the body 12.

Further, a second arm hole 104 that penetrates in a vertical direction (the direction of arrows C and D) perpendicular to the axial direction is formed in a center portion of the guide body 28, and the one end of the clamp arm 16 is inserted into the second arm hole 104. More specifically, the second arm hole 104 is disposed so as to face toward the opening 34 when the guide body 28 is positioned inside of the body 12 (see FIG. 4).

On the other hand, both side surfaces of the guide body 28 are formed in flat shapes, in contrast to the pair of arcuate surfaces, and further are formed with respective second link grooves 100 therein, which penetrate therethrough along with the second arm hole 104. The second link grooves 100 are each formed in the same shape on one side surface and the other side surface of the guide body 28, and the spindle 70, which is inserted through the one end of the clamp arm 16, is inserted respectively through the second link grooves 100.

Each of the second link grooves 100 includes a first groove portion 100*a*, which is formed on one end side of the guide body 28 that includes the connecting hole 102, and a second groove portion (inclined portion) 100*b*, which is joined to the first groove portion 100*a* and extends toward the other end side of the guide body 28. More specifically, the spindle 70 is disposed for displacement along the first groove portion 100*a* and the second groove portion 100*b*, which make up the second link groove 100.

The first groove portion 100*a* is formed substantially parallel to the axis of the guide body 28, whereas the second groove portion 100*b* extends while being inclined downwardly somewhat with respect to the axis of the guide body 28.

The rotating rollers 98*a*, 98*b* are rotatably disposed through a pair of roller axes 96*a*, 96*b*, which are provided respectively on the one end and the other end of the guide body 28, and are separated by a predetermined distance with respect to both side surfaces of the guide body 28. Specifically, the rotating rollers 98*a*, 98*b* are disposed respectively on both ends of the roller axes 96*a*, 96*b*, and further, are disposed in pairs respectively on the one end and the other end of the guide body 28.

Further, one of the roller axes 96*a*, 96*b* disposed on one end of the guide body 28 is inserted through the interior of the connecting hole 102, and also is inserted through the connecting hole 94 of the piston rod 30. Owing thereto, the guide body 28 and the piston rod 30 are interconnected, whereby the guide body 28 is displaceable along the axial directions (in the directions of arrows A and B) under a driving action of the cylinder 18 including the piston rod 30 thereof.

In addition, when the guide body 28 is disposed in the through hole 22 of the body 12, the roller axes 96*a*, 96*b* are inserted respectively through the guide holes 42*a*, 42*b* of the body 12 and project outside, and the rotating rollers 98*a*, 98*b* are mounted for rotation respectively on both ends thereof. The rollers 98*a*, 98*b* are disposed respectively between the pairs of guide rails 44*a*, 44*b*, so that when the guide body 28 is displaced along the axial direction, the rollers 98*a*, 98*b* move along the guide rails 44*a*, 44*b* while rotating. That is, displacement of the guide body 28 in the axial direction is guided by the rollers 98*a*, 98*b* and the guide rails 44*a*, 44*b*.

The clamp apparatus 10 according to the first embodiment of the present invention is constructed basically as described above. Next, explanations shall be made concerning operations and effects of the invention.

Figure 4:
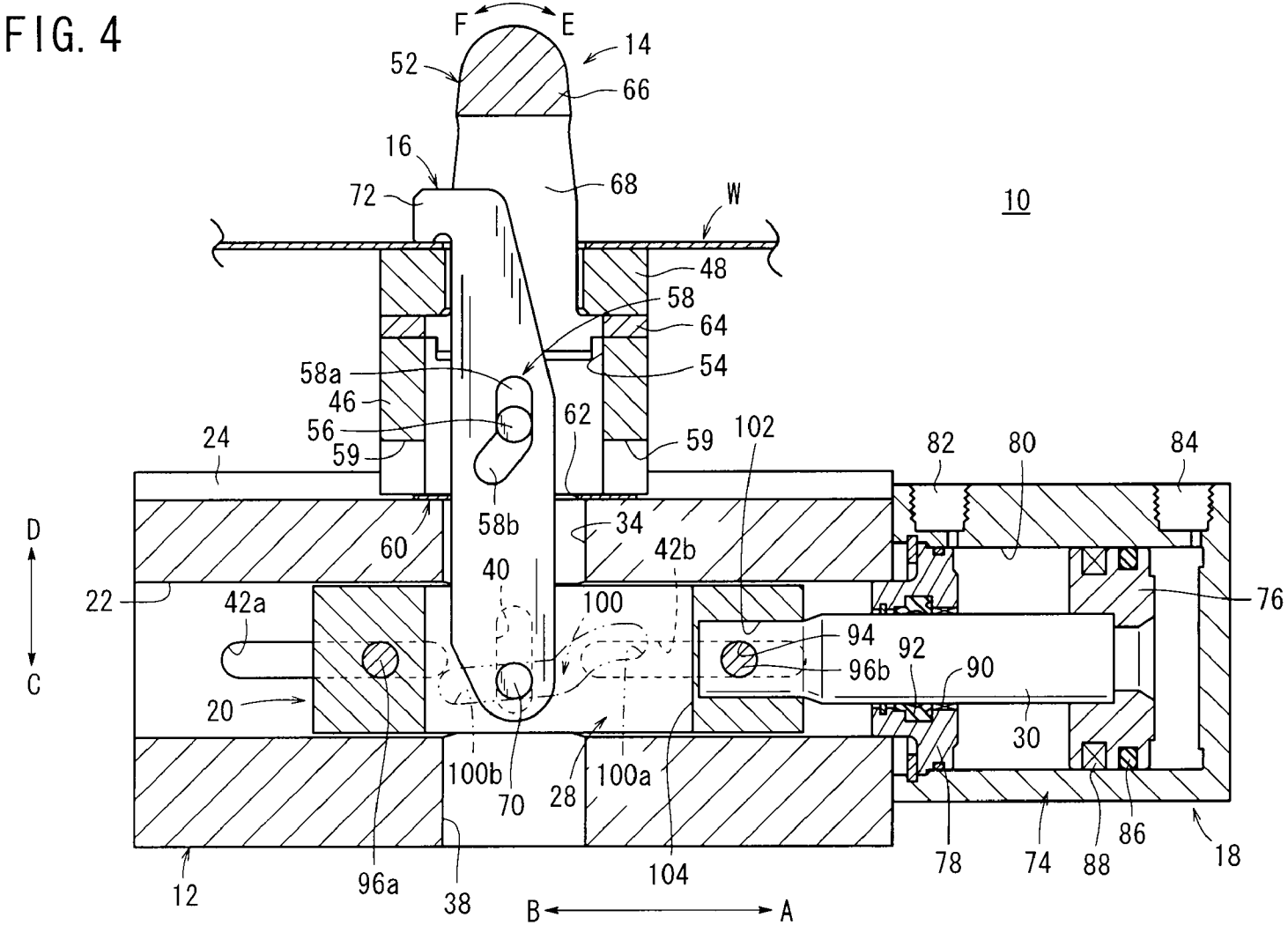
FIG. 4 is a vertical cross sectional view of the clamp apparatus shown in FIG. 1.
Figure 5:
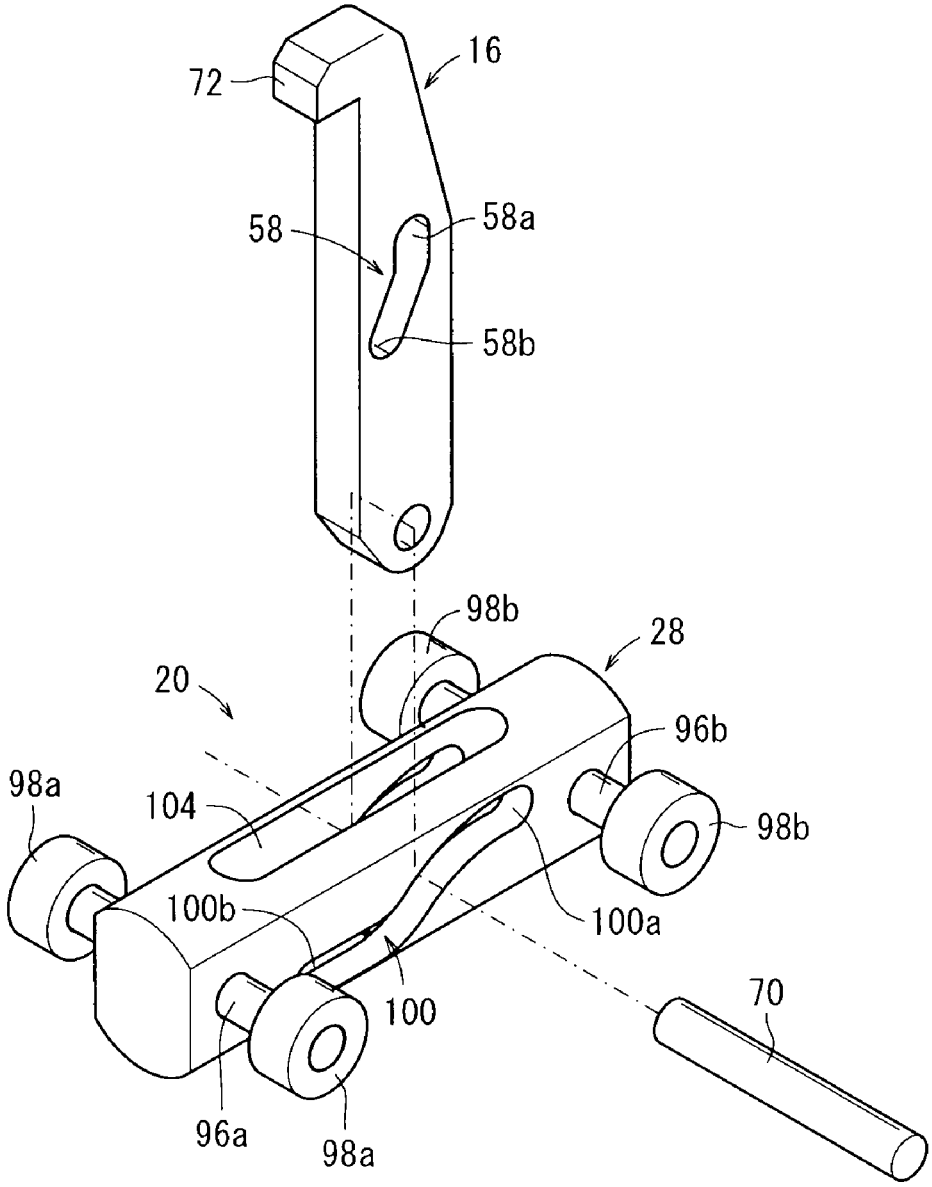
FIG. 5 is an exploded perspective view of a drive force transmission mechanism that constitutes part of the clamp apparatus shown in FIG. 1.
Figure 6:
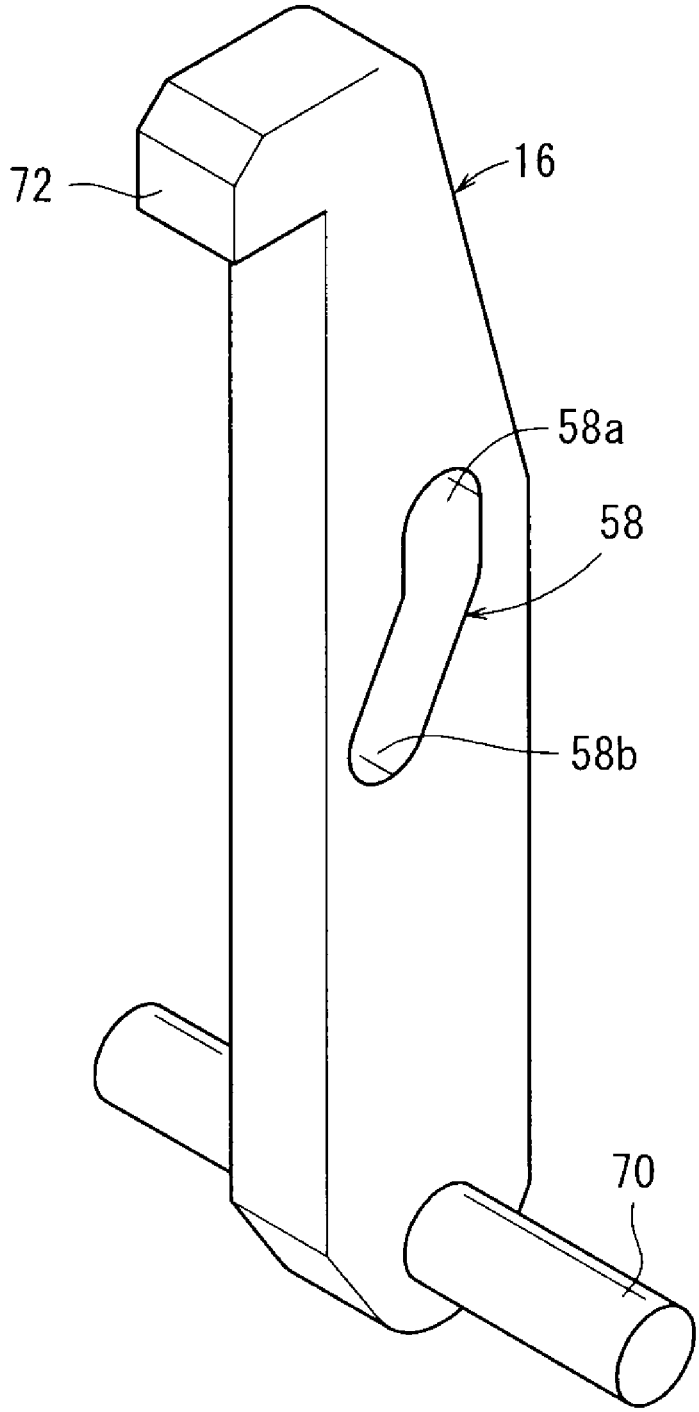
FIG. 6 is an exterior perspective view of a clamp arm constituting part of the drive force transmission mechanism of FIG. 5.

First, the clamp apparatus 10 is fixed in a predetermined position through a non-illustrated fixing mechanism, while non-illustrated pipings or the like connected to a pressure fluid supply source are connected respectively to the first and second ports 82, 84. In FIGS. 1, 2 and 4, the clamp apparatus 10 is shown in a clamped state, whereas in FIG. 7, the clamp apparatus is shown in an unclamped state. Below, the aforementioned unclamped state shall be described as defining an initial state.

Figure 7:
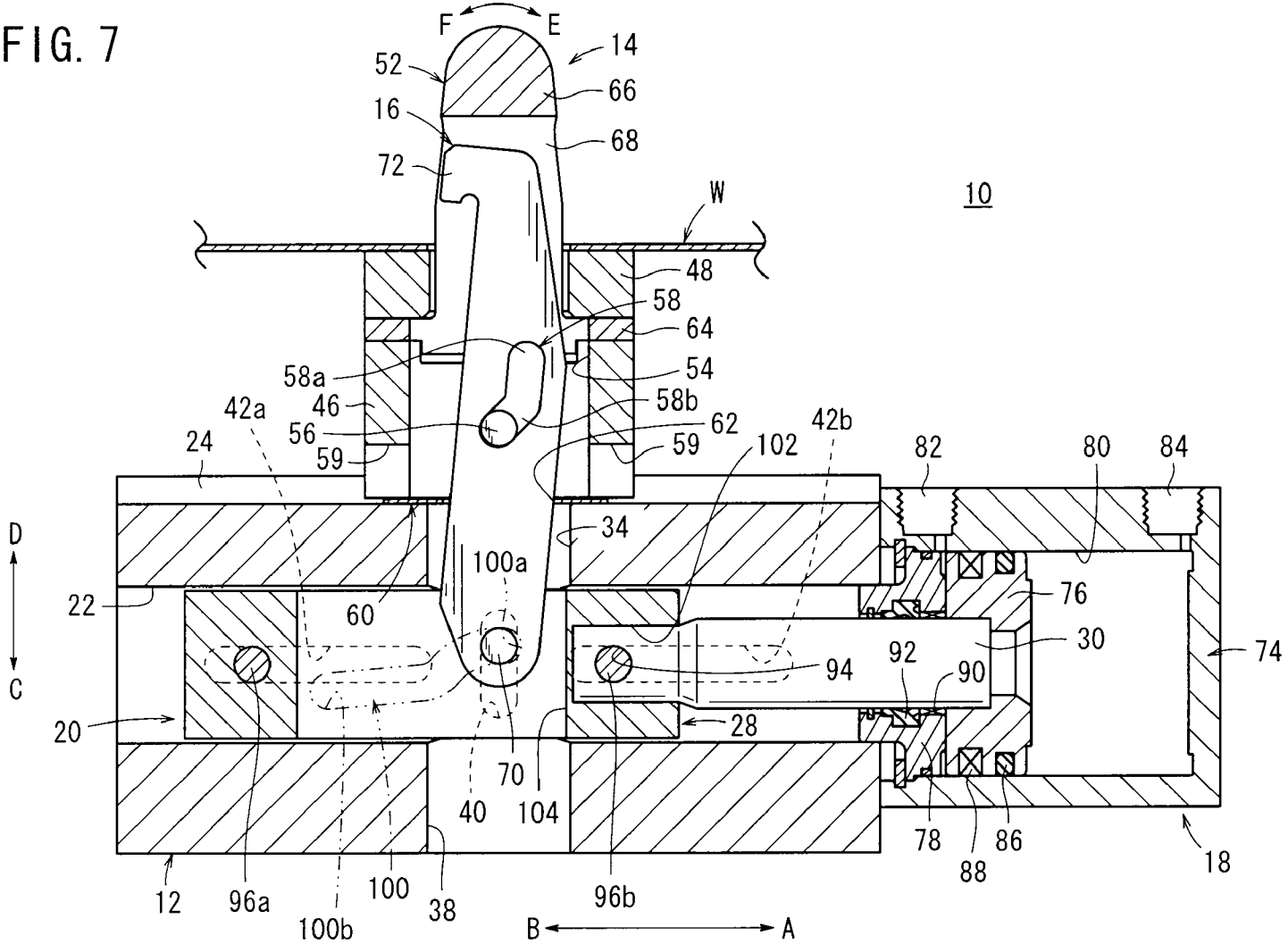
FIG. 7 is a vertical cross sectional view showing a state in which the clamp arm in the clamp apparatus of FIG. 4 is rotated and the held state of a workpiece is released.

In the initial state of the clamp apparatus 10 shown in FIG. 7, a pressure fluid is supplied to the first port 82 from a non-illustrated pressure fluid supply source, and the pressure fluid is introduced into the cylinder cavity 80. In this case, the second port 84 is placed in a state of being open to atmosphere.

Under an action of the pressure fluid introduced into the cylinder cavity 80, the piston 76 is pressed in a direction (the direction of the arrow A) to separate away from the body 12, and the piston 76 is displaced along the cylinder cavity 80 (see FIG. 4). In addition, the guide body 28 is displaced together with the piston 76 and the piston rod 30, and the guide body 28 is displaced toward the side of the cylinder 18 (in the direction of the arrow A) under the guidance of the rotating rollers 98*a*, 98*b* on the guide rails 44*a*, 44*b*. In this case, the rollers 98*a*, 98*b* are displaced while rotating between the pair of guide rails 44*a*, 44*b*.

Additionally, by displacement of the guide body 28 along the through hole 22 of the body 12, the spindle 70 inserted through the second link grooves 100 moves from the first groove portion 100*a* to the second groove portion 100*b* thereof, and the spindle 70 is pressed downward (in the direction of the arrow C) gradually along the second link grooves 100. In this case, because the spindle 70 is inserted through the link hole 40 of the body 12, the spindle 70 is not displaced in the axial direction (the direction of arrows A and B) of the body 12, but is displaced only in a vertical direction (the direction of arrows C and D).

As a result, the clamp arm 16 in which the spindle 70 is axially supported is displaced downward (in the direction of the arrow C) in its entirety in the first and second arm holes 54, 104, and the link shaft 56, which is inserted through the center portion of the clamp arm 16, moves from the second groove portion 58*b* toward the first groove portion 58*a* of the first link groove 58. Together therewith, the clamp arm 16 is rotated counterclockwise (in the direction of the arrow F) through a predetermined angle about the one end side of the clamp arm 16 in which the spindle 70 is axially supported. More specifically, the clamp arm 16 is rotationally displaced counterclockwise (in the direction of the arrow F) about the spindle 70 while the clamp arm 16 is displaced in a downward direction.

In addition, by abutment of the claw 72 disposed on the other end of the clamp arm 16 against the upper surface side of the workpiece W, the workpiece W is retained between the claw 72 and the plate 48 (see FIG. 4).

Further, when the clamp arm 16 is rotated and the workpiece W is retained, although a structure is provided in which the spindle 70 is displaced downwardly (in the direction of the arrow C) along the second link grooves 100 by displacement of the guide body 28, because the second groove portion 100*b* of the second link groove 100 is formed so as to be inclined in a downward direction somewhat with respect to the axis of the guide body 28, along with displacement of the guide body 28, the spindle 70 is pulled gradually downward.

Owing thereto, the clamp arm 16 that supports the spindle 70 also is pulled gradually downward (in the direction of the arrow C), and because the clamp arm 16 is rotated such that the claw 72 of the clamp arm 16 progresses even further toward the side of the workpiece W, the workpiece W can be retained more reliably and with greater strength. That is, the second groove portion 100*b* of the second link groove 100 functions as a thrust increasing mechanism, which is capable of increasing the force at which the workpiece W is retained by the clamp arm 16.

Figure 8:
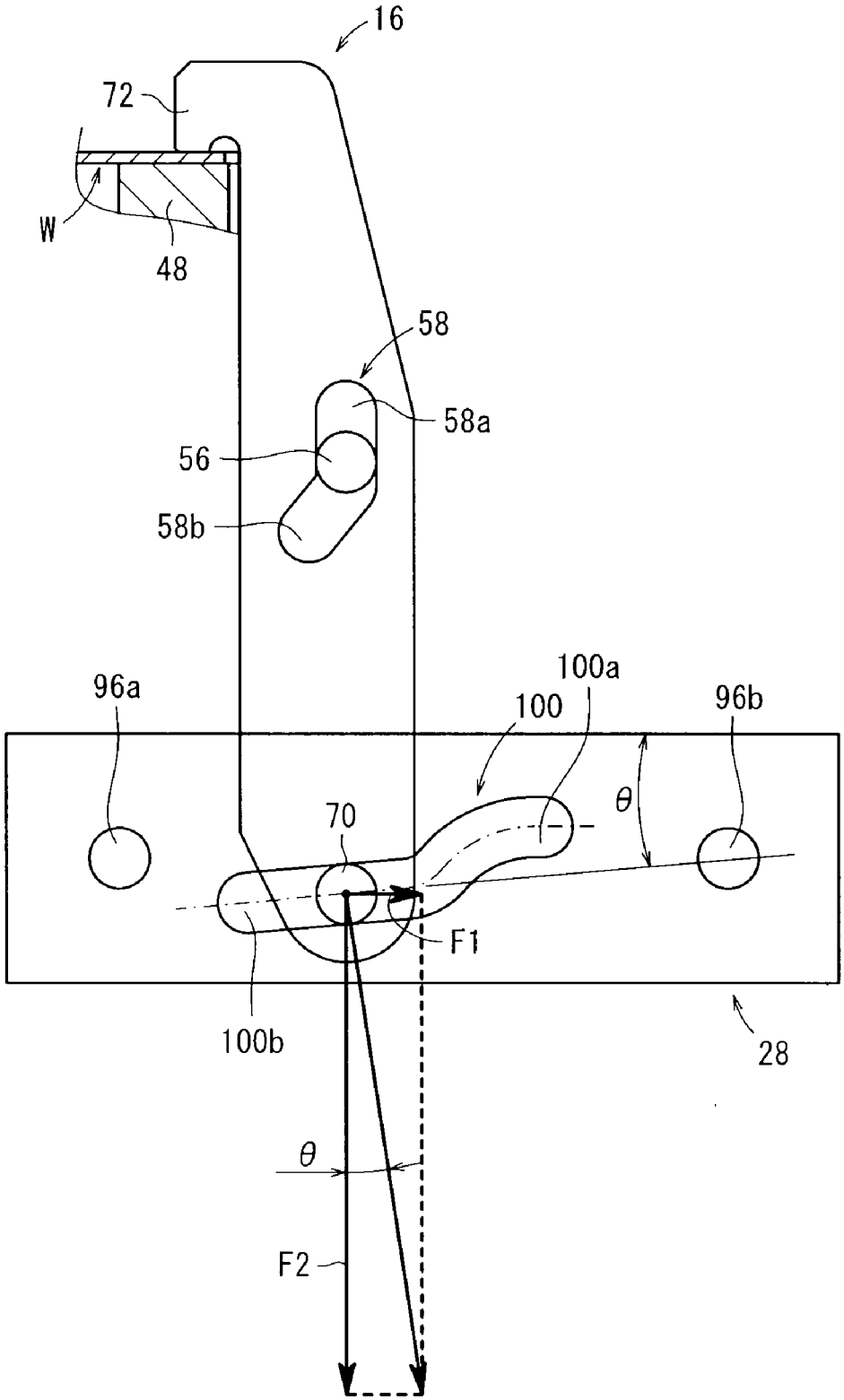
FIG. 8 is a conceptual diagram showing a relationship between forces applied with respect to a spindle that supports a clamp arm.

In greater detail, as shown in FIG. 8, the thrust force F1 (displacement force) from the cylinder 18, which is imposed with respect to the guide body 28, and the clamping force F2 by the clamp arm 16, can be represented by vectors as illustrated in the figure. Specifically, with the aforementioned thrust force increasing mechanism, the thrust force F1 from the cylinder 18 is applied along the axial direction of the cylinder 18, whereas the clamping force F2 by the clamp arm 16 is applied in a vertically downward direction perpendicular to the axial direction. Additionally, accompanying an increase in the thrust force F1 from the cylinder 18, the clamping force F2 on the workpiece W by the clamp arm 16 can also be increased.

Further, at this time, because the cover 60 through which the clamp arm 16 is inserted is displaced along the first recess 24 accompanying rotary movement of the clamp arm 16, the opening 34 of the body 12, which is covered by the cover 60, is not opened or unblocked as a result of the rotary movement of the clamp arm 16, and remains continuously closed and blocked even during times when the clamp arm 16 is moved.

Figure 9A:
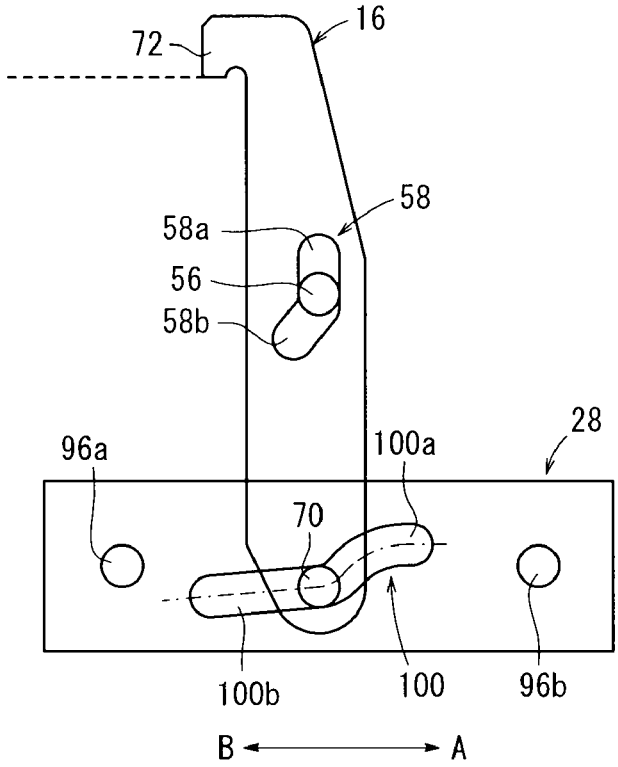
FIG. 9A is an operational explanatory diagram showing an initial state of clamping by the clamp arm.
Figure 9B:
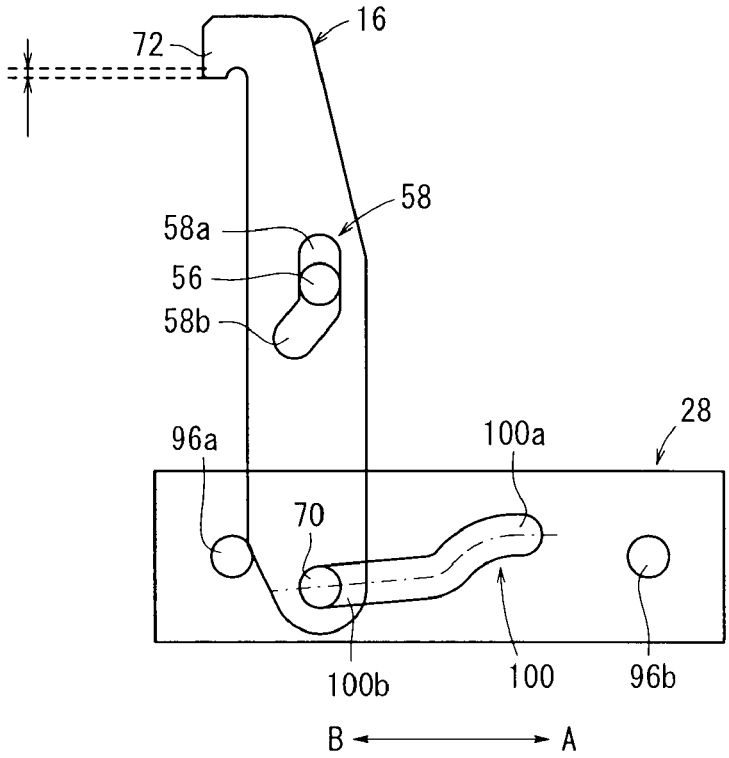
FIG. 9B is an operational explanatory diagram showing a condition in which the clamp arm is further rotated due to further displacement of a guide member.

Further, from the initial clamped state by the clamp arm 16 shown in FIG. 9A, as shown in FIG. 9B, by further displacement of the guide body 28 in the direction of the arrow A so that the spindle 70 is moved to the end of the second groove portion 100*b* within the second link groove 100, the clamp arm 16 is displaced further downward to achieve a fixed clamping force. In this manner, the workpiece W can be retained within a clamping range, from the initial clamping state shown in FIG. 9A to the maximum clamping state shown in FIG. 9B. Owing thereto, even in the case that a variance exists in the thickness of the workpieces W, such a variance can easily be responded to.

On the other hand, in the event that switching is carried out from the clamped state of the workpiece W shown in FIG. 4 to an unclamped state, under a switching action of an unillustrated changeover valve, the supply of pressure fluid to the first port 82 is stopped, and by supplying the pressure fluid to the second port 84, the piston 76 is displaced toward the side of the body 12 (in the direction of the arrow B). In this case, the first port 82 is placed in a state of being open to atmosphere. In addition, by displacement of the piston 76 and the piston rod 30 toward the side of the body 12, the spindle 70 inserted through the guide body 28 is moved from the second groove portion 100*b* toward the first groove portion 100*a* of the second link groove 100, and together therewith, the clamp arm 16 is displaced upwardly (in the direction of the arrow D) along the first and second arm holes 54, 104 together with the spindle 70.

Along therewith, the clamp arm 16 is rotated gradually clockwise (in the direction of the arrow E) about the spindle 70 through an engagement action of the link shaft 56, which is inserted through the first link groove 58.

As a result, the claw 72, which is disposed at the other end of the clamp arm 16, gradually separates from the workpiece W, and the clamped state of the workpiece W by the claw is released to provide an unclamped state.

In the foregoing manner, in the first embodiment, the spindle 70 that supports the end of the clamp arm 16 is inserted through the second link grooves 100 of the guide body 28, and moreover, the second link groove 100 is made up from a first groove portion 100*a*, which is substantially parallel with the axis of the guide body 28, and a second groove portion 100*b*, which is inclined downwardly with respect to the axis of the guide body 28. Additionally, the spindle 70 is displaced in upward and downward directions along the second link groove 100 under a displacement action of the guide body 28, which is displaced through the cylinder 18, and along therewith, the clamp arm 16 is rotated by a predetermined angle through the link shaft 56 inserted through the first link groove 58, thereby providing clamped and unclamped states.

At this time, because the second groove portion 100*b* of the second link groove 100 is inclined downwardly with respect to the axis of the guide body 28, when the spindle 70 engages within the second groove portion 100*b*, the spindle 70 is pulled gradually downward, whereupon the clamp arm 16 can be rotated toward the side of the workpiece W. As a result, in the clamped state, since the claw 72 of the clamp arm 16 can be pressed further with respect to the workpiece W, the workpiece W can be retained more reliably and with greater strength. That is, while the workpiece W is retained, the thrust force by the clamp arm 16 can be increased.

Stated otherwise, even in the case that a variance exists in the thickness of the workpieces W, the surface of the workpiece W can be reliably and suitably pressed by the claw 72 of the clamp arm 16, and the workpiece W can be retained between the claw 72 of the clamp arm 16 and the plate 48.

Figure 10A:
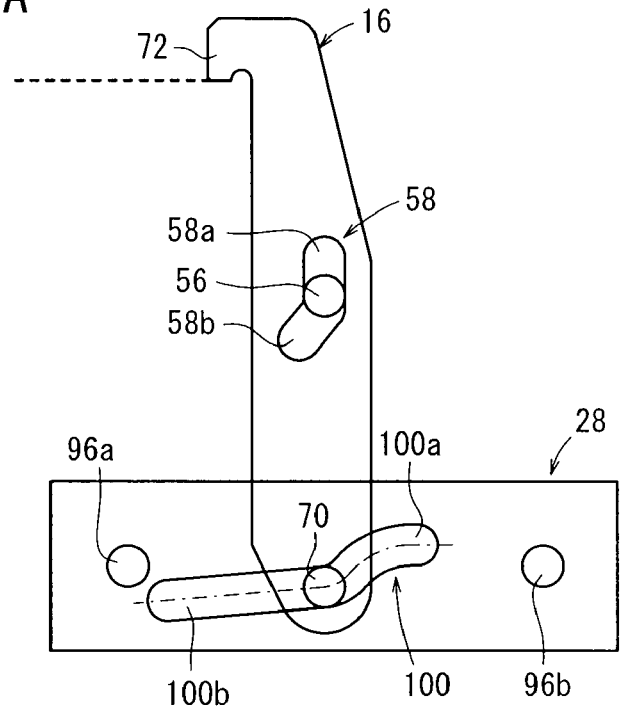
Figure 10B:
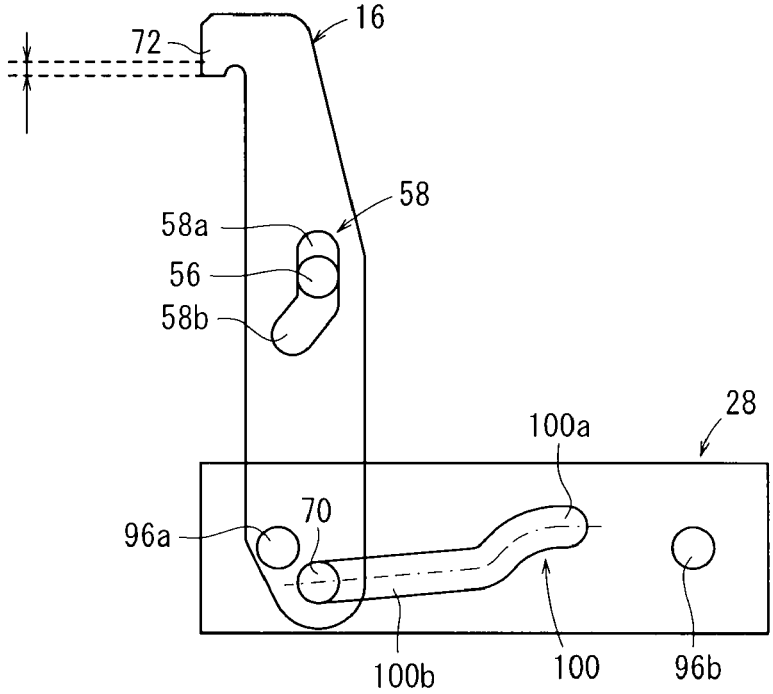

Furthermore, as shown in FIGS. 10A and 10B, by adjusting the length of the second groove portion 100*b* in the second link groove 100, the retainment range (clamping range) of the workpiece W during the clamping period of the clamp arm 16 can freely be adjusted. Specifically, by setting the length of the second groove portion 100*b* to be longer, the retainment range of the maximum clamping force by the clamp arm 16 can be increased (see FIG. 10B).

More specifically, the workpiece W is capable of being retained within a clamping range from the initial clamping state by the clamp arm 16 shown in FIG. 10A to the clamped state shown in FIG. 10B, and because the clamping range can easily be enlarged by setting a longer length for the second groove portion 100*b*, in the case of a variance in the width of the workpiece W, a greater tolerance range can be provided.

Further, the cover 60 is disposed over the opening 34 of the body 12, and the clamp arm 16 is inserted through the insertion hole 62, with the cover 60 being disposed displaceably along the first recess 24 of the body 12. Accordingly, for example, in the case that the clamp apparatus 10 is used on a welding line or the like for automobiles, invasion of foreign objects such as spatter or the like into the interior of the body 12 can be prevented. Furthermore, in the unlikely event that spattered foreign objects do enter into the body 12, such foreign objects can be discharged to the outside from the discharge hole 38 that is opened at the lower part of the body 12.

As a result, invasion of foreign matter into the interior of the body 12 containing the drive force transmission mechanism 20 therein can be prevented. Further, even in the case that such matter does invade into the body 12, since the foreign matter can easily be discharged to the outside, proper operation of the clamp arm 16 and the drive force transmission mechanism 20 is not impeded, and the clamp apparatus 10 can be smoothly operated. In addition, maintenance of the clamp apparatus can be facilitated and improved.

Figure 11:
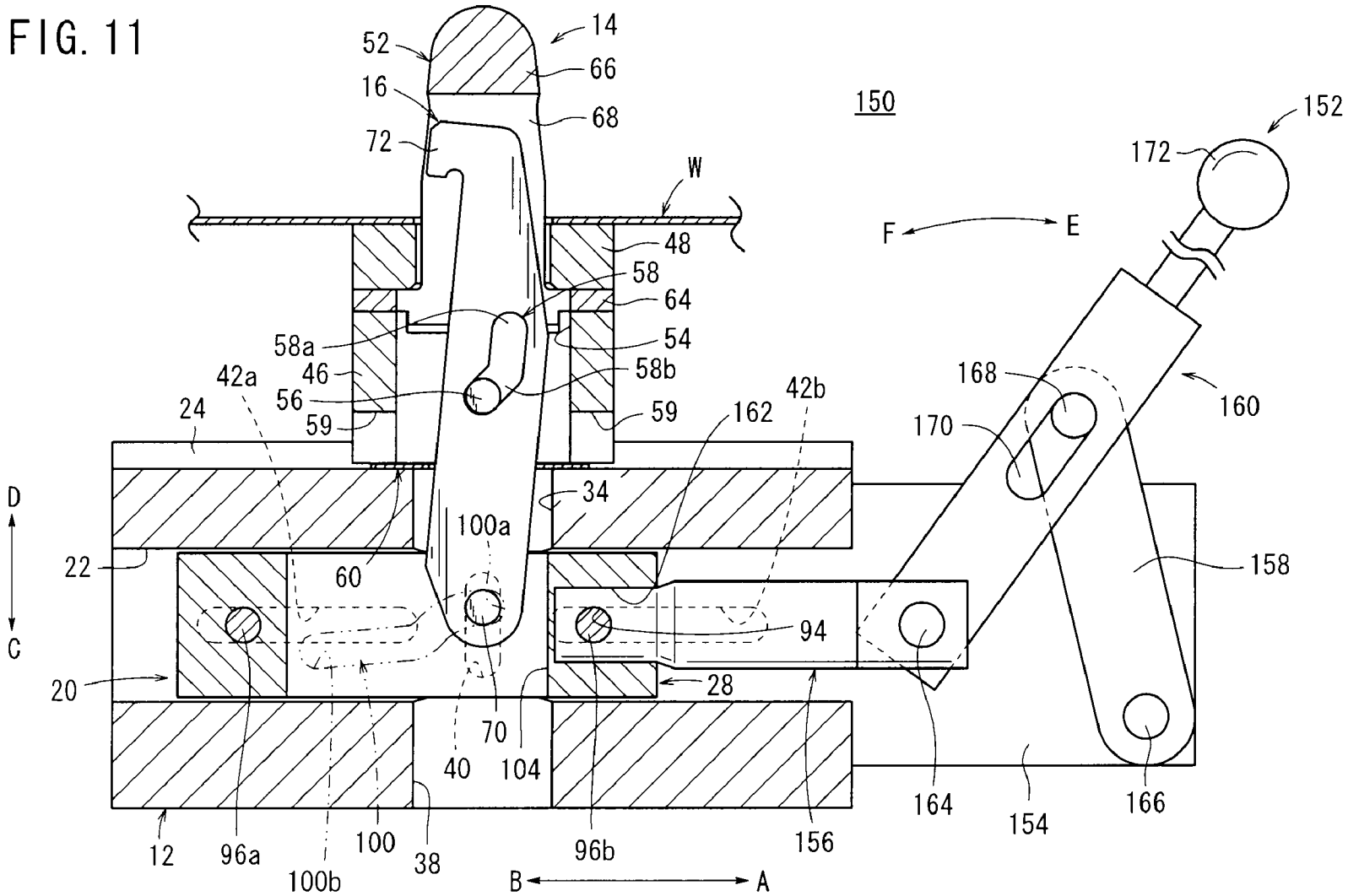
FIG. 11 is an overall cross sectional view of a clamp apparatus according to a second embodiment of the present invention.
Figure 12:
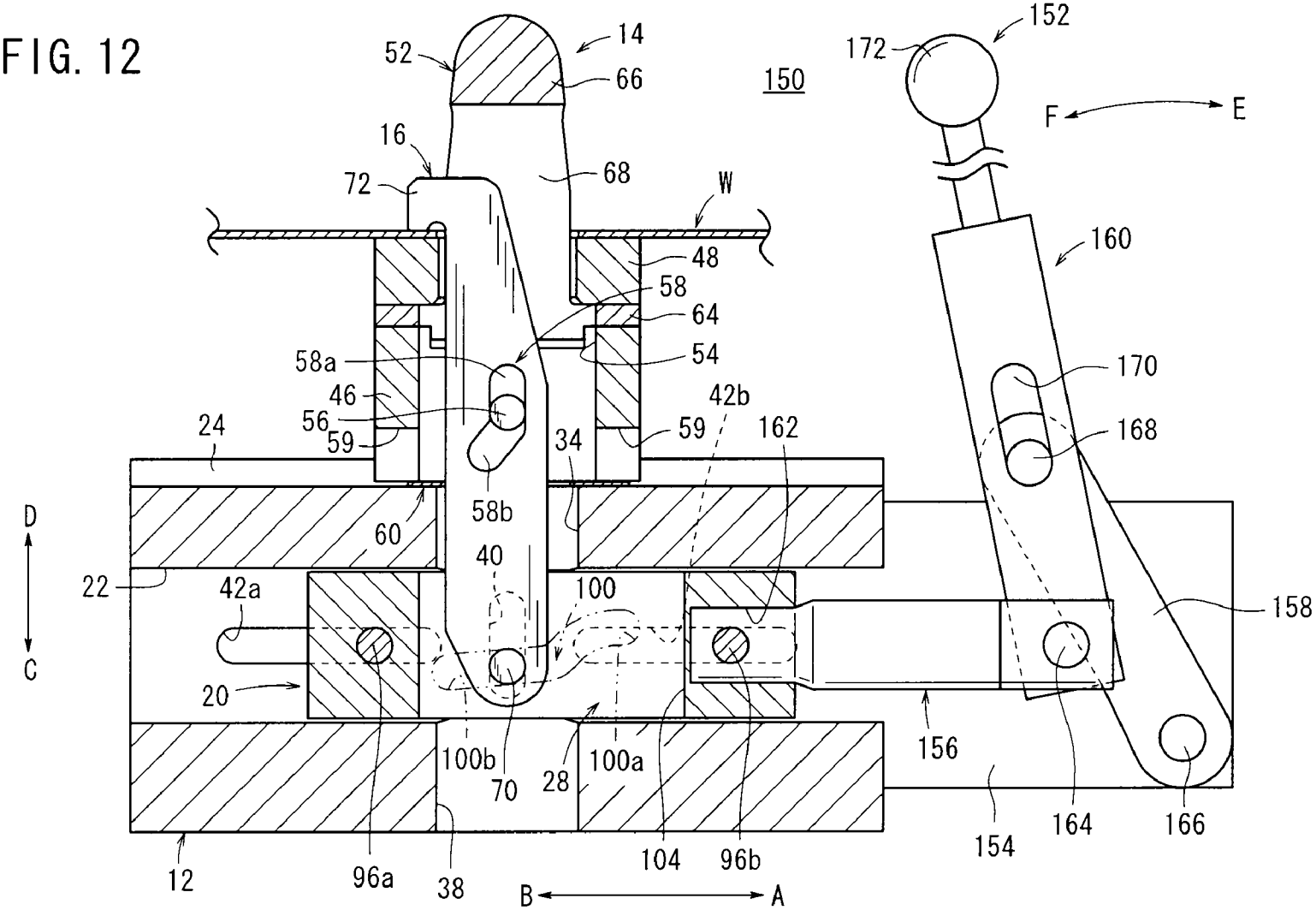
FIG. 12 is a cross sectional view showing a state in which a workpiece is retained by the clamp apparatus of FIG. 11.

Next, a clamp apparatus 150 according to a second embodiment is shown in FIGS. 11 and 12. Structural features which are the same as those of the clamp apparatus 10 according to the first embodiment are designated by the same reference numerals, and detailed explanation of such features is omitted.

The clamp apparatus 150 according to the second embodiment differs from the clamp apparatus 10 according to the first embodiment in that, instead of providing the cylinder 18 (see FIG. 4) which enables rotation of the clamp arm 16 under the supply of a pressure fluid, the clamp apparatus 150 is equipped with an operating section 152 which enables rotary movement of the clamp arm 16 manually, wherein the held state of the workpiece W can be switched by manual operation of the operating section 152 by an operator.

In the clamp apparatus 150, as shown in FIGS. 11 and 12, the operating section 152 is connected to an end of the body 12. The operating section 152 includes a housing 154 connected to the body 12, a connecting rod (displacement rod) 156 connected to the guide body 28 constituting the drive force transmission mechanism 20, a link arm 158 pivotally supported rotatably on the housing 154, and an operating lever (handle) 160 connected to the link arm 158 and to the connecting rod 156, and which is capable of being manually operated by an operator.

The connecting rod 156 is inserted displaceably through the interior of the housing 154 and is displaced in the axial direction of the body 12 and the housing 154. One end of the connecting rod 156 is connected to an end of the guide body 28 by means of a roller axis 96*b* inserted through the connecting hole 162. The other end of the connecting rod 156 is axially supported through a connecting shaft 164 at one end of the operating lever 160.

The link arm 158 is provided on an end of the housing 154, one end of the link arm 158 being pivotally supported rotatably through a support shaft 166. A link shaft 168 is axially supported at the other end of the link arm 158, and is rotatable by insertion through an oblong link hole 170 formed in a center portion of the operating lever 160.

The operating lever 160 is formed with a predetermined length, wherein one end of the operating lever 160 is pivotally supported at the other end of the connecting rod 156, and a spherical gripping member 172, which is easily grasped by the operator, is disposed on the other end of the operating lever 160.

Next, operations of the clamp apparatus 150 having the aforementioned operating section 152 shall briefly be explained.

First, in an unclamped state of the workpiece W as shown in FIG. 11, the operating lever 160 making up the operating section 152 is in a state of being inclined about the connecting shaft 164 at a predetermined angle in a direction away from the body 12 (in the direction of the arrow E). In addition, in the case that the workpiece W is to be clamped, an operator (not shown) grasps the gripping member 172, and rotates the operating lever 160 toward the side of the body 12 (in the direction of the arrow F).

Accordingly, accompanying rotary movement of the operating lever 160, the other end side of the link arm 158 is rotatably displaced toward the side of the body 12 about the support shaft 166, and the connecting rod 156, which is connected to one end of the operating lever 160, is pulled in a direction (the direction of arrow A) away from the body 12. At this time, the link shaft 168 moves along the link hole 170 of the operating lever 160. As a result, together with the connecting rod 156, the guide body 28 is displaced along the body 12, and the spindle 70 inserted through the second link grooves 100 is pressed downward (in the direction of the arrow C). Along therewith, by downward displacement of the clamp arm 16, the claw 72 is rotated counterclockwise by a predetermined angle so as to face the workpiece W. As a result, the claw 72 of the clamp arm 16 abuts against the upper surface of the workpiece W, providing a clamped state (see FIG. 12) in which the workpiece W is clamped and retained between the claw 72 and the plate 48.

On the other hand, in the clamped state shown in FIG. 12, in the case that the unclamped state is restored again, the operator (not shown) grasps the operating lever 160, and by rotating the operating lever 160 in a direction away from the body 12 (in the direction of the arrow E) about the connecting shaft 164, the connecting rod 156 is displaced so as to be pressed inwardly toward the side of the body 12. Owing thereto, the guide body 28 connected to the connecting rod 156 is displaced along the axial direction in a direction away from the operating section 152. As a result, the spindle 70 inserted through the second link grooves 100 is displaced upwardly (in the direction of the arrow D), and along therewith, by upward displacement of the clamp arm 16, the clamp arm 16 is rotated clockwise by a predetermined angle so that the claw 72 moves away from the workpiece W. Thus, the clamped state of the workpiece W by the claw 72 of the clamp arm 16 is released, resulting in an unclamped state.

In the foregoing manner, in the second embodiment, in place of the cylinder 18 used in the first embodiment, an operating section 152 operable by manual operations of an operator is provided, wherein the clamped state of the workpiece W by the clamp arm 16 can be switched by operation of the operating section 152. Owing thereto, there is no need to provide the pressure fluid supply source or pipes for supplying the pressure fluid, and clamped and unclamped states of the workpiece W can be switched by means of a simple structure. Further, since the operating section 152 can provide a simpler structure compared to the cylinder 18, the number of parts can be reduced, along with enabling reductions in manufacturing costs and the number of assembly steps.

The clamp apparatus according to the present invention is not limited to the above embodiments, and it is a matter of course that various alternative or additional structures could be adopted without departing from the essence or gist of the present invention.

What is claimed is:

1. A clamp apparatus for converting linear motion output from a driving section into rotary motion and clamping a workpiece through a clamp arm, the clamp apparatus comprising:

a body;

a driving section connected to the body and having a displacement rod that is displaceable along an axial direction of the body;

a clamp arm supported rotatably with respect to the body;

a drive force transmission mechanism including a displacement body connected to the displacement rod for displacement along the body, and a link groove extending in an axial direction of the displacement body and through which a spindle that supports an end of the clamp arm is inserted, the drive force transmission mechanism transmitting a drive force from the driving section to the clamp arm, wherein the clamp arm is rotatably displaced by causing displacement of the spindle along the link groove; and a thrust increasing mechanism disposed in the drive force transmission mechanism for increasing a clamping force when the workpiece is retained by the clamp arm, wherein the thrust increasing mechanism is made up from an inclined portion, which is formed in the link groove and extends while being inclined at a predetermined angle with respect to an axis of the displacement body, and further, wherein the spindle engages with the inclined portion at a time of clamping when the workpiece is supported by the clamp arm, and wherein the inclined portion causes gradual rotation of the clamp arm via the spindle in a direction for clamping the workpiece, and wherein the body includes an opening through which the clamp arm is inserted, a cover being installed over the opening and capable of displacement along the axial direction of the body.

2. The clamp apparatus according to claim 1, wherein the displacement body includes a guide mechanism for guiding the displacement body along the axial direction of the body.

3. The clamp apparatus according to claim 1, wherein the body includes a link hole therein for guiding the spindle along a direction perpendicular to the axis of the body.

4. The clamp apparatus according to claim 1, wherein the driving section comprises a cylinder having a piston to which the displacement rod is connected, and which is displaced in the axial direction of the body under a pressing action of a pressure fluid.

5. The clamp apparatus according to claim 1, wherein a hole is formed in a lower part of the body communicating between the interior and the exterior of the body, wherein dust in the interior of the body may be discharged to the exterior through the hole.

6. The clamp apparatus according to claim 1, wherein a clamp unit including the clamp arm therein comprises a main body portion disposed on an upper part of the body, which supports the clamp arm tiltably through a link shaft, the main body portion including a discharge opening for discharging foreign matter eliminated through the cover.

7. The clamp apparatus according to claim 1, wherein the cover includes an insertion hole therein through which the clamp arm may be inserted, an opening area of the insertion hole being set smaller than an opening area of the opening.

8. The clamp apparatus according to claim 1, wherein the cover is displaceable, accompanying rotational movement of the clamp arm, along a recess disposed in the body.

9. A clamp apparatus for converting linear motion output from a driving section into rotary motion and clamping a workpiece through a clamp arm, the clamp apparatus comprising:

a body;

a driving section connected to the body and having a displacement rod that is displaceable along an axial direction of the body;

a clamp arm supported rotatably with respect to the body;

a drive force transmission mechanism including a displacement body connected to the displacement rod for displacement along the body, and a link groove extending in an axial direction of the displacement body and through which a spindle that supports an end of the clamp arm is inserted, the drive force transmission mechanism transmitting a drive force from the driving section to the clamp arm, wherein the clamp arm is rotatably displaced by causing displacement of the spindle along the link groove;

a guide mechanism for guiding the displacement body along the axial direction of the body, the guide mechanism comprising a plurality of guide rails fixed to the body and extending in the axial direction of the body, and a plurality of rollers rotatably provided at the displacement body for movement with the displacement body along the axial direction of the body, the rollers cooperating with the guide rails to guide the displacement body along the axial direction of the body; and a thrust increasing mechanism disposed in the drive force transmission mechanism for increasing a clamping force when the workpiece is retained by the clamp arm, wherein the thrust increasing mechanism is made up from an inclined portion, which is formed in the link groove and extends while being inclined at a predetermined angle with respect to an axis of the displacement body, and further, wherein the spindle engages with the inclined portion at a time of clamping when the workpiece is supported by the clamp arm, and wherein the inclined portion causes gradual rotation of the clamp arm via the spindle in a direction for clamping the workpiece.

* * * * *